US005344377A

United States Patent [19]

Meeks

[11] Patent Number: 5,344,377

[45] Date of Patent: Sep. 6, 1994

[54] DRIVE LINE BRAKE ASSEMBLY FOR SCORING/SLOTTING APPARATUS

[75] Inventor: William R. Meeks, Lawrence, Kans.

[73] Assignee: Lawrence Paper Company, Lawrence, Kans.

[21] Appl. No.: 18,859

[22] Filed: Feb. 17, 1993

[51] Int. Cl.[5] ..... B31B 1/14; B31B 1/25

[52] U.S. Cl. ..... 493/368; 83/332

[58] Field of Search ..... 493/60, 64, 161, 355, 493/365-370, 479; 83/332, 368, 369, 437, 677, 76.7, 76.8

[56] References Cited

U.S. PATENT DOCUMENTS

| | | | |
|---|---|---|---|
| 3,067,643 | 12/1962 | Ward, Jr. | 83/332 |
| 3,466,982 | 9/1969 | Sullivan | 493/365 |
| 3,952,637 | 4/1976 | Lambert | 83/332 |
| 4,003,300 | 1/1977 | Grobman | 493/365 |
| 4,090,433 | 5/1978 | Jardine | 493/370 |
| 4,805,502 | 2/1989 | Ishigure | 493/368 |

*Primary Examiner*—Jack W. Lavinder

*Attorney, Agent, or Firm*—Hovey, Williams, Timmons & Collins

[57] ABSTRACT

Multiple-station article processing apparatus (10) is provided which includes an adjustable processing station (14), a drive train (20), and a selectively operable drive train brake assembly (22) operable during adjustment of station (14). The preferred apparatus (10) is designed for fabrication of box blanks, and to this end includes an infeed assembly (12) for sequentially feeding paperboard sheets into the downstream scoring/slotting station where the sheets are scored and slotted to yield finished box blanks. During makeready adjustments when the position of the knives (66, 68) of the station (14) are changed, the braking assembly (22) is actuated to prevent unintended rotation of the drive train (20), which can result in changing the properly timed relationship of the stations within apparatus (10). The braking assembly (22) preferably includes a drum (80) secured to line shaft (74) of drive train (20), with a pair of pivotally mounted brake arms (88, 90) adjacent the drum (80); a piston and cylinder assembly (98) interconnects the outer ends of the arms (88, 90), and is actuated to move the arms (88, 90) into braking engagement with drum (80) during makeready adjustments.

7 Claims, 2 Drawing Sheets

DRIVE LINE BRAKE ASSEMBLY FOR SCORING/SLOTTING APPARATUS

BACKGROUND OF THE INVENTION

1. Field of the Invention

The present invention is broadly concerned with improved multiple-station article processing apparatus such as that used in the box-making industry for the production of box blanks. More particularly, it is concerned with equipment of this type which preferably includes a selectively operable braking assembly operatively associated with the drive train of the equipment, which serves to engage and brake the drive train during equipment makeready adjustments in order to prevent unintended movement of the drive train which can have the effect of improperly altering the timed operational relationship of the various stations of the apparatus.

2. Description of the Prior Art

Box-making plants universally make use of large equipment designed for the high speed fabrication of box blanks from starting paperboard sheets. In general, these machines are operable to individually feed paperboard sheets from a stack thereof into a scoring and slotting station where the sheets are appropriately scored and slotted to form the side panels and end flaps required for box blanks. Thereafter, the finished blanks are delivered to a counting and stacking station, for ultimate delivery to the end users.

U.S. Pat. No. 5,181,899 (incorporated by reference herein) describes an improved box blank fabricating apparatus especially designed for very rapid changeover and makeready operations. To this end, the various stations of the apparatus are operated in a timed relationship with each other via a drive train including a motor, line shaft, gear boxes and shafts supporting the operative components of the unit (e.g., scoring and slotting wheels). In addition, the equipment described in the '899 patent is provided with novel adjustment apparatus allowing rapid, accurate alteration of the positions of the fixed and adjustable knives of the slotting wheels, all without the necessity of individual adjustment of each wheel. Such knife adjustment can be automatically controlled, and is accomplished by means of compensators operatively secured with the scoring and slotting shafts, with an intermediate transfer gear between each associated scoring and slotting wheel.

In experimental practice with the apparatus described in this patent, it has been determined that makeready adjustments involving changes in slotter wheel knife positions can have the unintended effect of slightly advancing or retarding the drive train of the machine. This is a problem, because such unintended rotation of the drive train components has the effect of altering the timing between the various stations of the apparatus. As a consequence, while knife adjustments may be properly made, the apparatus will still produce improperly configured blanks, owing to the out-of-time operation of the equipment. Therefore, the machine must again be stopped, and the drive train rezeroed before proper operation can commence.

There is accordingly a need in the art for an improved multiple-station article processing apparatus having adjustable processing station(s) wherein mistiming of station operation is prevented during adjustments of the operating components of the stations.

SUMMARY OF THE INVENTION

The present invention overcomes the problems outlined above, and provides an improved multiple-station article processing apparatus equipped with means for preventing alteration of the timed operational relationship of the stations of the apparatus during makeready adjustments thereof.

Broadly speaking, the article processing apparatus of the invention is of the type including at least one article processing station having powered article processing means for performing a first operation on a first article (or series thereof) fed into and through the processing station, together with power means including a movable drive train for operating the stations of the apparatus in a timed relationship with each other. The apparatus further includes selectively usable adjustment means for changing the operation of the article processing means, in order to perform a second operation on a second article (or series thereof) fed into and through the processing station. This type of multiple-station apparatus is improved in accordance with the invention by provision of braking means for preventing alteration of the timed operational relationship of the stations of the apparatus. This braking means includes structure for selectively engaging the drive train and preventing movement thereof during use of the adjustment means.

In the context of box blank fabrication equipment, one article processing station would be a scoring/slotting station for scoring and slotting of individual paperboard sheets in order to produce box blanks. In such equipment, the article processing means of the scoring/slotting station includes a plurality of laterally spaced apart, rotatable slotting wheels and associated scoring wheels, wherein the slotting wheels carry a pair of circumferentially spaced knives. the adjustment means permits changing the circumferential position(s) of the adjustment knives. As described previously, a particularly preferred box blank fabricating apparatus of this type is described in U.S. Pat. No. 5,181,899.

In any event, the typical drive train forming a part of the apparatus in accordance with the invention includes an elongated, axially rotatable line shaft coupled between a source of motive power and suitable transmissions and/or gear boxes, the latter being coupled with rotatable shafts carrying processing components (e.g., knives or scoring elements).

In preferred forms of the invention, the drive braking device is operable for engaging and braking the line shaft during use of the adjustment apparatus associated with the station(s). Advantageously, a brake drum is secured to and rotatable with the line shaft, and one or more brake pads are supported on appropriate brake arms adjacent the drum; a piston and cylinder assembly is operably coupled between the brake arms and is operable for moving the brake pads into braking engagement with the drum during use of the station adjustment means.

DETAILED DESCRIPTION OF THE PREFERRED EMBODIMENTS

Figure 1:
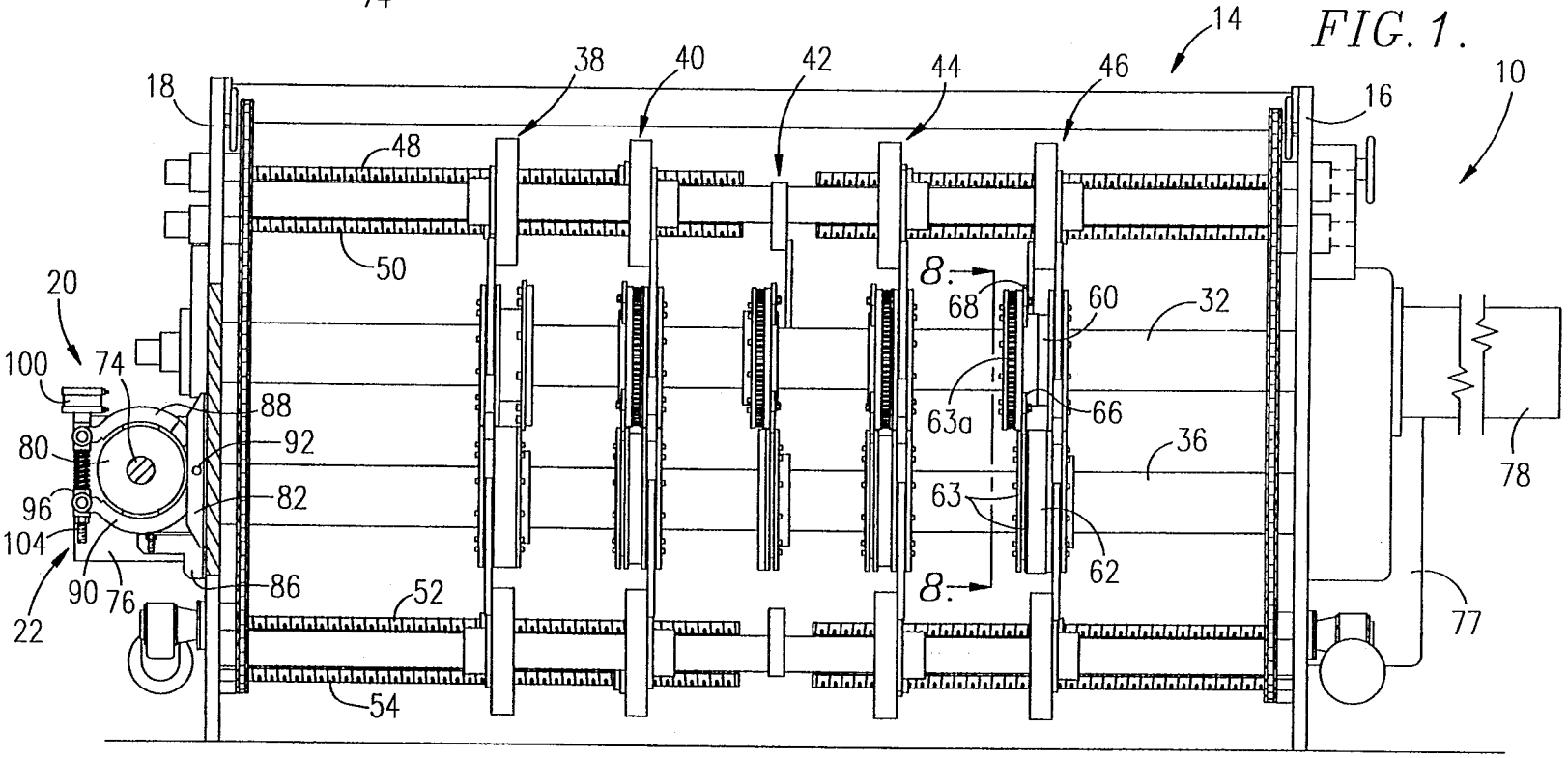
FIG. 1 is a rear elevational view of the scoring/slotting station of a box blank fabricating machine in accordance with the invention, and illustrating the preferred line shaft brake assembly.
Figure 6:
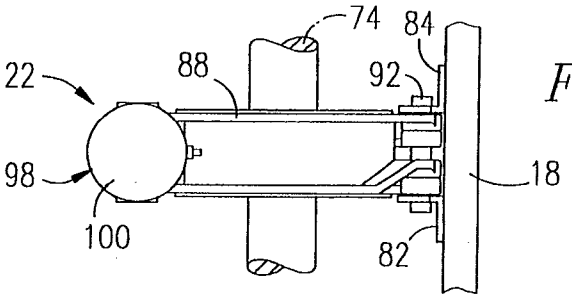
FIG. 6 is a plan view of the braking assembly of the invention.
Figure 7:
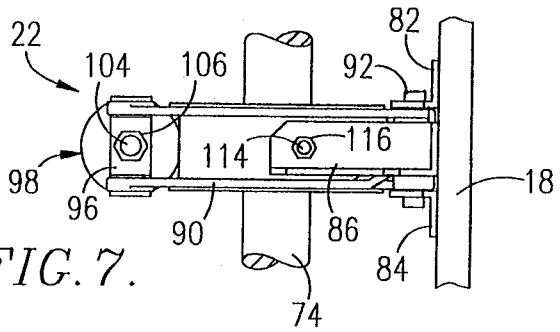
FIG. 7 is a bottom view of the brake assembly of the invention.
Figure 2:
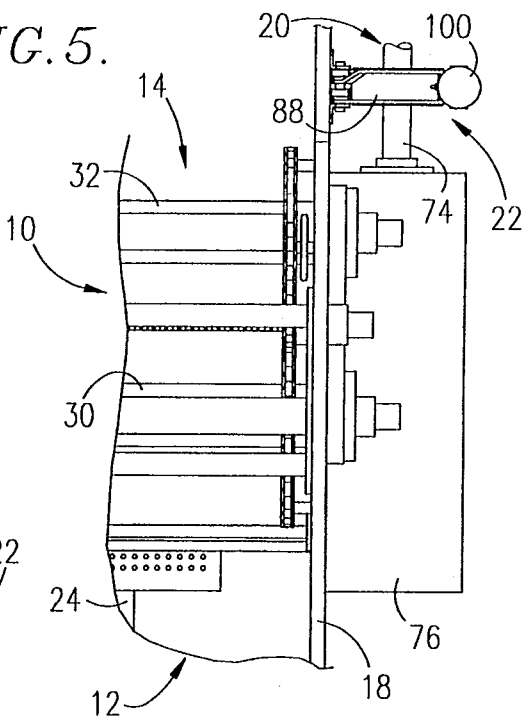
FIG. 2 is a fragmentary top view illustrating a portion of the apparatus depicted in FIG. 1, in particular the sheet infeed station, the scoring/slotting station, a portion of the drive train, and the drive train brake thereof.

Turning now to the drawings, and particularly FIGS. 1–2, multiple-station box blank fabricating apparatus 10 is illustrated. The overall apparatus is of the type described in U.S. Pat. No. 5,181,899 (incorporated by reference), which can be consulted for all necessary details. The apparatus 10 broadly includes an inlet feeder assembly 12 defining the input end of the apparatus, as well as scoring/slotting assembly 14 adapted to receive individual paperboard sheets from the feeder assembly 12, and to process the same to form a completed blank having scores and slots therein. The assemblies 12, 14 are supported in their operative dispositions by means of a frame assembly including side frames 16, 18, and are driven by a drive train 20. Finally, a drive train brake assembly 22 is also provided for selectively engaging the drive train 20 during adjustment of station 14. It will also be appreciated that the complete apparatus 10 would normally be equipped with downstream counting and stacking apparatus (not shown) for the purpose receiving finished blanks and producing counted bundles thereof for customer shipment.

In more detail, the feeder assembly 12 includes a vacuum feeder table 24 adapted to receive and support a stack of paperboard sheets to be sequentially fed through the apparatus 10. The overall assembly 12 is further provided with a reciprocal pusher element designed to sequentially engage and feed individual paperboard sheets into and through the station 14 on a timed basis. All relevant details of the preferred assembly 12 are fully described in U.S. Pat. No. 5,181,899.

The scoring/slotting assembly 14 is positioned downstream of the feeder assembly 12, and is designed to receive the individually fed paperboard sheets and provide appropriate score lines and slots therein, together with glue tab formation and trimming, so as to create a final box blank. The inlet end of the assembly 14 includes a pair of powered, counter-rotating feed rollers 26, 28 which extend between the side frames 16, 18.

Figure 8:
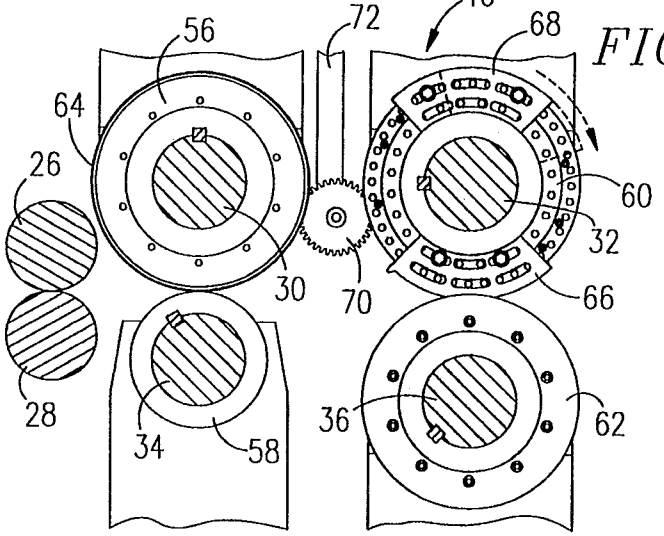
FIG. 8 is a vertical sectional view taken along line 8—8 of FIG. 1 and further depicting the construction of the scoring/slotting station.

Attention is specifically directed to FIG. 8 which illustrates the operating components of the station 14. Specifically, a total of four powered, axially rotatable cross-shafts 30, 32, 34, 36 are provided between the side frames 16, 18, namely upper score shaft 30, lower score shaft 34, and upper and lower slotting shafts 32, 36. Referring to FIG. 1, it will be observed that the assembly 14 in the form shown has a total of five laterally spaced apart scoring/slotting units 38, 40, 42, 44, 46, with the central unit 42 being fixed and the remaining units being laterally adjustable by means of powered drive screws 48, 50, 52, 54. Exemplary unit 46 is illustrated in FIG. 8 and incudes an upper scoring wheel assembly 56 mounted on shaft 30, a lower scoring wheel assembly 58 mounted on shaft 34, an upper slotter wheel assembly 60 mounted on shaft 32, and an lower slotter wheel assembly 62 mounted on shaft 36.

The upper scoring wheel assembly 56 includes a central hub keyed to shaft 30, and has an outermost continuous protrusion 64 in order to provide the necessary scoring action. The lower scoring wheel assembly 58 consists simply of an annular anvil ring keyed to shaft 34 and presenting a flattened resilient outer surface adapted to coact with protrusion 64.

The upper slotter wheel assembly 60 includes a central hub keyed to shaft 32. This wheel assembly supports a pair of slotting blades, specifically a tipped slotting blade 66 fixed relative to the wheel, and an adjustable slotting blade 68. Each of these blades is provided with a plurality of arcuate mounting slots therein for screw attachment. The adjustable blade 68 is secured to an outer pull ring by means of screws, and is circumferentially adjustable as fully described in the aforementioned U.S. Pat. No. 5,181,899.

The lower slotter wheel assembly 62 includes a hub keyed to shaft 36 and a pair of annular, spaced apart, continuous knife blades 63 bolted to the hub and oriented for receiving therebetween the fixed and adjustable blades 66, 68 of assembly 60 during operation.

A rotatable transfer gear 70 (FIG. 8) is situated between and in mesh with ring gears **63*a* provided on the assemblies 56, 60. The transfer gear 70 is rotatably supported on an upright 72 between the upper scoring and slotting assemblies 56, 60**.

The drive train 20 includes a motor (not shown) operably coupled with a line shaft 74, the latter being connected with gear boxes 76 and 77 having internal gearing arrangements for appropriate rotation of the shafts 30–36 and operation of the feeder assembly 12, all in a precisely timed relationship. As best seen in FIG. 1, individual compensators 78 associated with gear box 77 are operatively connected with the upper shafts 30, 32, and the drive train operates through gear box 77 and these compensators during normal running operation for rotation of the upper shafts. The lower shafts 34, 36 are directly coupled with the drive train without intermediate compensators. It will further be understood that the complete drive train associated with apparatus 10 includes the powered transverse shafts 30–36, as well as the other drive components described in U.S. Pat. No. 5,181,899.

Figure 4:
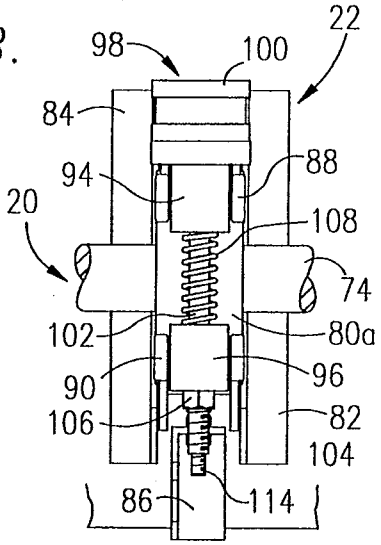
FIG. 4 is a fragmentary front view of the braking assembly.

The brake assembly 22 includes an annular metallic brake drum 80 which is fixedly secured to line shaft 74 adjacent the input of gear box 76 (see FIG. 2). The drum 80 presents a flattened outer peripheral surface **80*a* as best seen in FIG. 4**.

Figure 5:
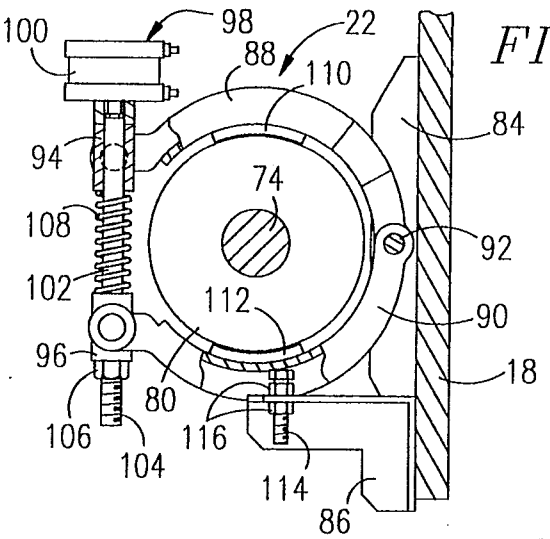
FIG. 5 is a view similar to that of FIG. 3, but illustrating the braking assembly with parts broken away and in the release position thereof.
Figure 3:
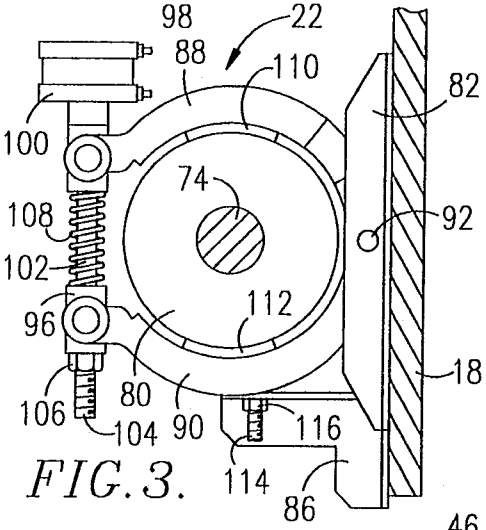
FIG. 3 is an enlarged side view of the line shaft brake assembly, illustrating the latter in its braking position.

The overall assembly 22 further includes a pair of spaced apart mounting brackets 82, 84 secured to side frame 18, as well as a lower stop bracket 86 interposed between the latter. A pair of arcuate, bifurcated brake arms 88, 90 are pivotally coupled together at their inner ends between brackets 82, 84 by means of pin 92, thereby allowing pivoting of these arms about a generally horizontal axis. The outer, free ends of the arms 88, 90 are each provided with a respective, tubular pivot blocks 94 or 96, and these are designed to support an air operated piston and cylinder assembly 98. The assembly 98 includes cylinder 100 secured to upper pivot block 94 and having an extensible rod 102 extending downwardly therefrom. The outer end of rod 102 extends through lower pivot block 96 and is threaded as at 104. A nut 106 is employed for securing the threaded end 104 of rod 102 to the lower block 96. A return spring 108 is disposed about rod 102 between the pivot blocks 94, 96, and engages the latter (see FIGS. 3 and 5).

Each of the arms 88, 90 carries on its inner surface an arcuate brake pad 110, 112 configured for engaging the peripheral surface of brake drum 80. In addition, the bracket 86 (see FIG. 5) carries an upright bolt 114 secured by nuts 116, with the head of bolt 114 being adapted to engage lower brake arm 90. In this fashion, the screw 114 serves as a lower limit stop for brake arm 90.

The operation of apparatus 10 will next be described, it being first assumed that the apparatus is properly adjusted and timed for the production of one style of finished box blank. In this orientation, a stack of paperboard sheets is placed on table 24 and the pusher element (not shown) associated with the assembly 12 is caused to reciprocate through the medium of drive train 20. Such reciprocation causes sheets from the stack to be sequentially fed in timed relationship into station 14 for scoring and slotting thereof. As each sheet is thus fed, it is first picked up by the powered rollers 26, 28 for passage through the scoring and slotting units 38–46. As the sheets pass through the scoring assemblies, the respective lower anvil rings support the sheets, while continuous scores are created by the scoring protrusions on the scoring wheels.

As the scored sheets proceed through the upper and lower slotting wheel assemblies, the desired slots are created therein, along with a glue flap and edge trimming. Rotation of the respective scoring and slotting wheel assemblies is accomplished through the medium of drive train 20 and compensators 78 previously described. Finished blanks are ultimately discharged from the output end of the station 14 and are then conventionally counted and bundled for customer shipment.

After a given run is completed, it is often necessary to change the configuration of the blank-forming machine to accept sheets of a different size, and to produce scoring and slotting therein at (perhaps) different lateral positions and to different depths on the starting sheets. In this respect, it will be understood that the lateral positions of the scoring and slotting wheel assemblies are known via appropriate servo-sensors, while the circumferential positions of the knives carried by the slotting wheels are likewise known because of additional servo-sensors. At the same time, a reference position of the infeed assembly pusher element is also known.

The outputs from the respective servo-sensors are directed to a central, conventional control panel for the apparatus, which has input capability permitting the operator to reset the blank forming apparatus by changing the reference position of the pusher element, the lateral positions of the scoring and slotting units, and the circumferential position of the slotting wheel blades.

In particular, the lateral positions of the scoring and slotting wheels of units 38, 40 and 44, 46 are altered by appropriate powered rotation of the screws 48–54.

In order to adjust the circumferential positions of the fixed knives 66, the compensator coupled with upper slotter shaft 32 comes into play. That is, the associated compensator motor is actuated to advance or retard the position of the fixed blades 66; this also causes shaft 30 to rotate as well.

Circumferential adjustment of the knives 68 as shown in phantom in FIG. 8 is made through the medium of compensator 78 coupled with upper scoring wheel shaft 30. In this case, the compensator motor is actuated which in turn advances or retards shaft 30, but this does not serve to rotate adjacent shaft 32. Rather, the individual transfer gears 70 operate in this sequence to adjust the position of the blades 68.

As explained previously, during knife adjustment, the drive train 22 can undergo unintended rotation which can upset the timing between the various stations of apparatus 10. In order to prevent this from occurring, the braking assembly 22 is actuated during knife adjustment. In particular, when the knife adjustment is underway, an appropriate signal is sent to piston and cylinder assembly 98, causing retraction of piston rod 102 against the bias of spring 108 and movement of the pads 110, 112 into braking engagement with drum 80. This positively prevents rotation of the drum 80 and consequently any rotation of line shaft 74 and the remainder of drive train 20. When the knife adjustment and other makeready operations are complete, another signal is sent to assembly 98, which allows extension of rod 102 under the influence of spring 108 until the brake assembly 22 assumes its release position illustrated in FIG. 5, i.e., with the pads 110, 112 out of contact with drum 80.

It will thus be seen that the present invention provides a means of preventing unintended disruption of the timing between the various stations of apparatus 10 during makeready adjustments. Therefore, these adjustments can be precisely and rapidly made, without fear of mistiming of the apparatus 10.

Although the preferred braking assembly 22 is illustrated in association with line shaft 74, those skilled in the art will appreciate that the drive train 20 could be braked at any one of a number of desired locations, e.g., at different points of the line shaft 74, within an associated gear box, or at one of the powered shafts.

I claim:

1. In a multiple-station carton blank processing apparatus including at least one scoring/slotting station having a powered rotatable slotting wheel carrying a pair of knives for performing a slotting operation on a first sheet, a movable drive train for operating the stations of said apparatus in a timed relationship with each other, a selectively usable adjustment means for changing the relative circumferential position of said knives in order to perform a second slotting operation on a second sheet fed into and through the scoring/slotting station, and a means for preventing alteration of the timed operational relationship of stations of said apparatus, including structure for selectively engaging said drive train and preventing movement thereof during use of said adjustment means.

2. The apparatus of claim 1, said drive train including an elongated, axially rotatable line shaft, said drive train-engaging structure including means for engaging said line shaft.

3. The apparatus of claim 2, said line shaft-engaging means including a brake drum secured to and rotatable with said line shaft, a brake pad engageable with said drum, and means operably coupled with said brake pad for selectively moving said brake pad into braking engagement with said drum in order to prevent unintended rotation of the line shaft.

4. The apparatus of claim 3, said brake pad moving means comprising a piston and cylinder assembly.

5. The apparatus of claim 3, including a pair of pivotally mounted arcuate brake arms disposed adjacent said drum, each of said arms supporting a brake pad, said brake pad moving means including a piston and cylinder assembly operably coupled with said arms.

6. The apparatus of claim 1, said adjustment means including selectively operable motive means coupled with said article processing means, said drive train-engaging structure being actuated during operation of said motive means.

7. The apparatus of claim 1, said scoring/slotting station including means for accepting and processing individually, sequentially fed articles.

* * * * *